US012163273B2

(12) United States Patent
Berti et al.

(10) Patent No.: US 12,163,273 B2
(45) Date of Patent: Dec. 10, 2024

(54) ROLLER IRONING PRESS

(71) Applicant: ALI GROUP S.R.L., Cernusco Sul Naviglio (IT)

(72) Inventors: Filippo Andrea Berti, Lake Bluff, IL (US); Umberto Bulf, Sedico (IT)

(73) Assignee: ALI GROUP S.R.L., Cernusco Sul Naviglio (IT)

( * ) Notice: Subject to any disclaimer, the term of this patent is extended or adjusted under 35 U.S.C. 154(b) by 55 days.

(21) Appl. No.: 18/057,994

(22) Filed: Nov. 22, 2022

(65) Prior Publication Data

US 2023/0167600 A1 Jun. 1, 2023

(30) Foreign Application Priority Data

Nov. 30, 2021 (IT) ..... 102021000030227

(51) Int. Cl.
*D06F 65/06* (2006.01)
*D06F 67/02* (2006.01)
*D06F 67/10* (2006.01)

(52) U.S. Cl.
CPC ..... *D06F 65/06* (2013.01); *D06F 67/02* (2013.01); *D06F 67/10* (2013.01)

(58) Field of Classification Search
CPC ..... D06F 65/02; D06F 65/06; D06F 65/08
USPC ..... 38/56
See application file for complete search history.

(56) References Cited

U.S. PATENT DOCUMENTS 1,671,500 A 5/1928 Wise
1,909,628 A * 5/1933 Perry ..... D06F 65/06 38/60

FOREIGN PATENT DOCUMENTS

DE D311372 C 3/1919
DE 861985 C 1/1953
DE 1610066 A1 11/1970
IT 1268689 A 6/1997

OTHER PUBLICATIONS

IT Search Report issued Jul. 12, 2022 re: Application No. 202100030227, pp. 1-11, citing: DE 861 985 C, DE 16 10 066 A1 and U.S. Pat. No. 1,671,500 A.
European Search Report for European Application No. 22208579.7, dated May 8, 2023, 11 pages.
European Office Action for Application No. 22208579.7, dated Jul. 4, 2024, 4 pages.

* cited by examiner

*Primary Examiner* — Nathan E Durham
(74) *Attorney, Agent, or Firm* — CANTOR COLBURN LLP

(57) ABSTRACT

A roller ironing press including between two supporting shoulders, respectively a first shoulder and a second shoulder:

a motorized roller, which cooperates with one or more pressers, the one or more pressers being heated and shaped complementarily to the roller, and elements for moving the one or more pressers toward the roller.

Elements for moving the one or more pressers toward the roller include at least one cable which extends between pulleys, the cable being moved by drive elements which are kinematically connected to at least one of its ends.

13 Claims, 8 Drawing Sheets

ROLLER IRONING PRESS

CROSS-REFERENCE TO RELATED APPLICATIONS

This application is related to and claims the benefit of Italian Patent Application No. 102021000030227, filed on Nov. 30, 2021, the contents of which are herein incorporated by reference in their entirety.

TECHNICAL FIELD

The present disclosure relates to a roller ironing press.

BACKGROUND

Nowadays different types of ironing presses are known and widespread on the market.

Among these are "roller ironing presses" which are normally used for the industrial ironing of linen of large dimensions.

Such apparatuses comprise, between two shoulders of the structure, a motorized roller which usually has a soft surface for contact with the linen, over which the laundry is moved. On the roller a heated presser means is pushed, at least partially shaped complementarily thereto, called an "ironing basin".

During operation the linen advances between the roller and the basin and, as the linen advances, the presser means is pressed against the roller in order to iron the linen that is placed between them.

In order to enable movement of the presser toward and away from the roller, means for moving the latter are used.

For example the roller ironing press is known, described in Italian patent no. 1268689 by this same applicant.

In such ironing press, the roller is motorized by way of a transmission chain and a gear motor, and the presser means can translate along a radial direction with respect to the former, by virtue of end tabs that can slide in guides defined by slotted holes present on each shoulder of the structure.

The guides are inclined with respect to the vertical, above the roller, and a downward-extending parallelepiped block is bolted onto each end tab of the presser means, a rod being articulated by way of a pivot to such block, such rod being internally provided with rack that meshes with a freewheel keyed on the axis of the roller.

The end of a gas-filled cylinder, coupled to a respective shoulder, is articulated on the rod, at the end opposite to the freewheel, said gas-filled cylinder is adapted to push the rod downward and therefore push the presser means against the roller.

The stroke of the rod to move the presser means away from the roller is, on the other hand, determined by the action of a microswitch positioned on one of the guide elements.

Such apparatus has met with enormous success from the commercial point of view, but naturally with the passage of time, improvements will be sought.

These improvements are aimed at improving aspects of this known art, and of other, similar conventional apparatuses, which display room for improvement.

In particular, an aspect that shows room for improvement is the presence of components for moving the presser means, which are subject to wear over time.

In fact elements such as rods, wheels, racks and gas-filled cylinders are subject to wear deriving from the friction that is normally generated between the various parts that interact during the normal use of the ironing press.

Furthermore, similar apparatuses are complicated in construction and are not straightforward to produce owing to the complexity of the individual elements to be assembled together and of the positioning that these must have with respect to each other.

Also, the presence of elements such as rods, wheels, racks and cylinders results in considerable manufacturing costs.

SUMMARY

The aim of the present disclosure is to provide an ironing press that is capable of improving the known art in one or more of the above mentioned aspects.

Within this aim, an object of the disclosure is to provide a roller ironing press that has fewer components with respect to similar conventional apparatuses and/or the components of which are less prone to wear with respect to similar conventional apparatuses.

Another object of the disclosure is to provide a roller ironing press that is simpler in construction and more straightforward to manufacture with respect to similar conventional apparatuses.

Furthermore, the present disclosure sets out to overcome the drawbacks of the background art in a manner that is alternative to any existing solutions.

Another object of the disclosure is to provide a roller ironing press that is highly reliable, easy to implement and of low cost.

This aim and these and other objects which will become better apparent hereinafter are achieved by a roller ironing press comprising, between two supporting shoulders, respectively a first shoulder and a second shoulder:

- a motorized roller, which cooperates with one or more presser means,
- said one or more presser means being heated and shaped complementarily to said roller,
- means for moving said one or more presser means toward said roller,
- said ironing press being characterized in that said means for moving said one or more presser means toward said roller comprise at least one cable which extends between a plurality of pulleys, said cable being moved by drive means which are kinematically connected to at least one of its ends.

BRIEF DESCRIPTION OF THE DRAWINGS

Further characteristics and advantages of the disclosure will become better apparent from the description of some preferred, but not exclusive, embodiments of a roller ironing press according to the disclosure, illustrated by way of non-limiting example in the accompanying drawings wherein.

DETAILED DESCRIPTION OF THE DRAWINGS

Figure 1:
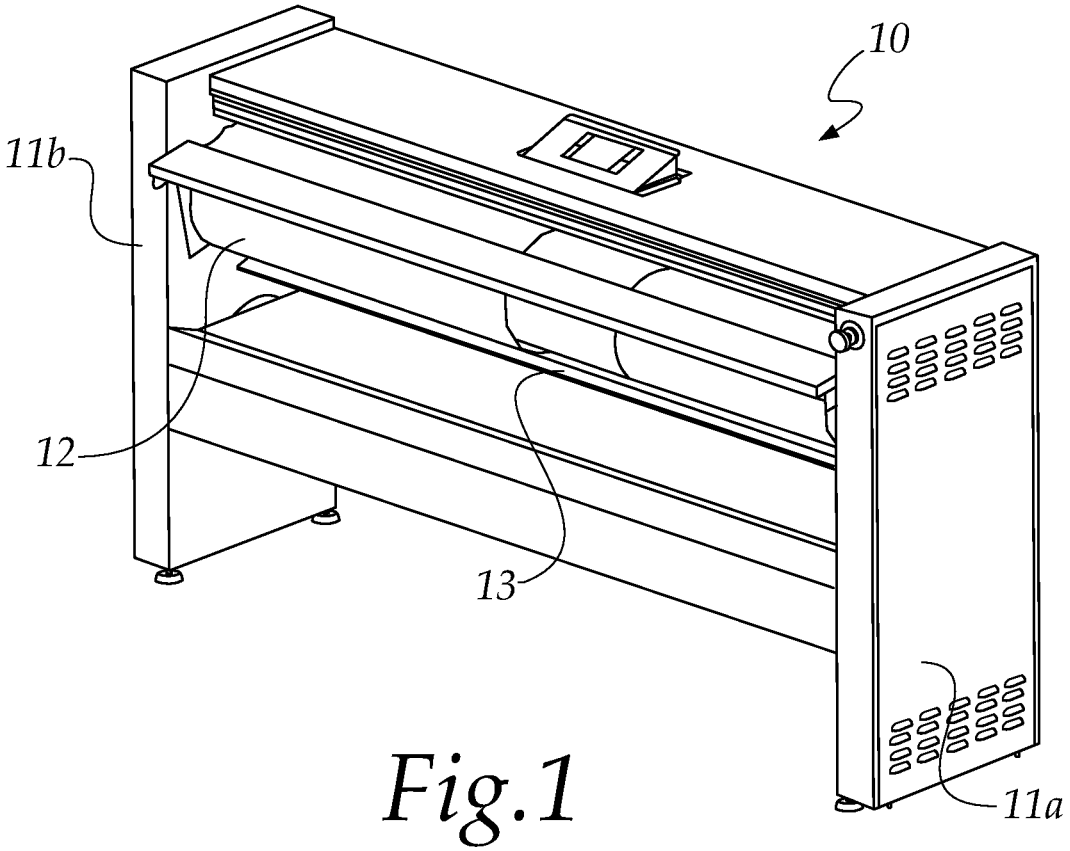
FIG. 1 is an overall perspective view of a roller ironing press according to the disclosure, in a first embodiment.

With reference to the figures, an ironing press according to the disclosure, in a first embodiment, is generally designated by the reference numeral 10.

The ironing press 10 comprises, between two supporting shoulders 11*a*, 11*b*, respectively a first shoulder 11*a* and a second shoulder 11*b:*

- a motorized roller 12, which cooperates with a presser means 13,
- such presser means 13, heated, and shaped complementarily to the roller 12,
- means 14 for moving the presser means 13 toward the roller 12.

In another embodiment, not shown in the figures, there are more than one presser means.

Each shoulder 11*a*, 11*b* has a box-like body for containing other components of the ironing press 10, described below.

Figure 2:
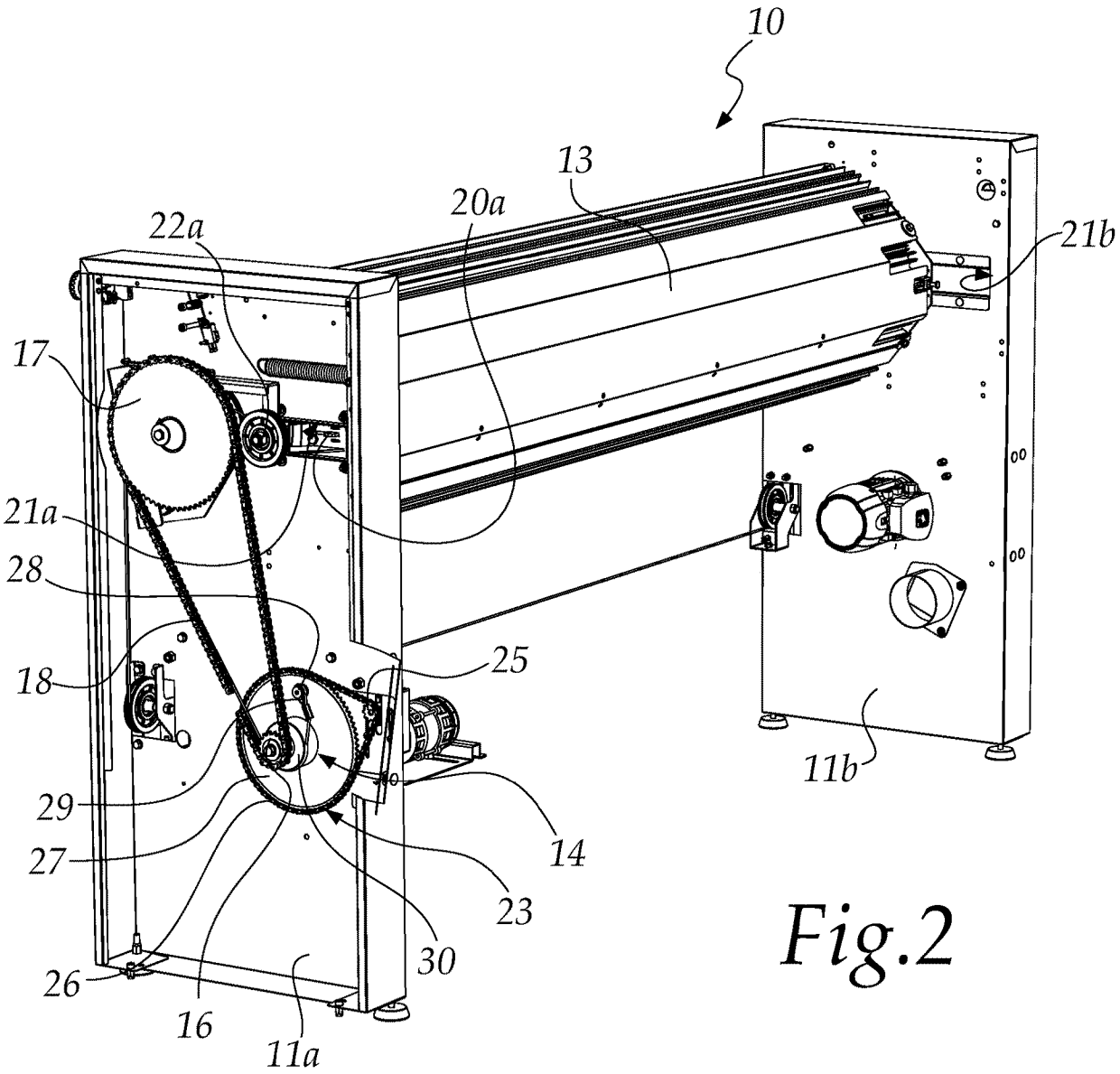
FIG. 2 is a first partial perspective view of the ironing press of FIG. 1.
Figure 3:
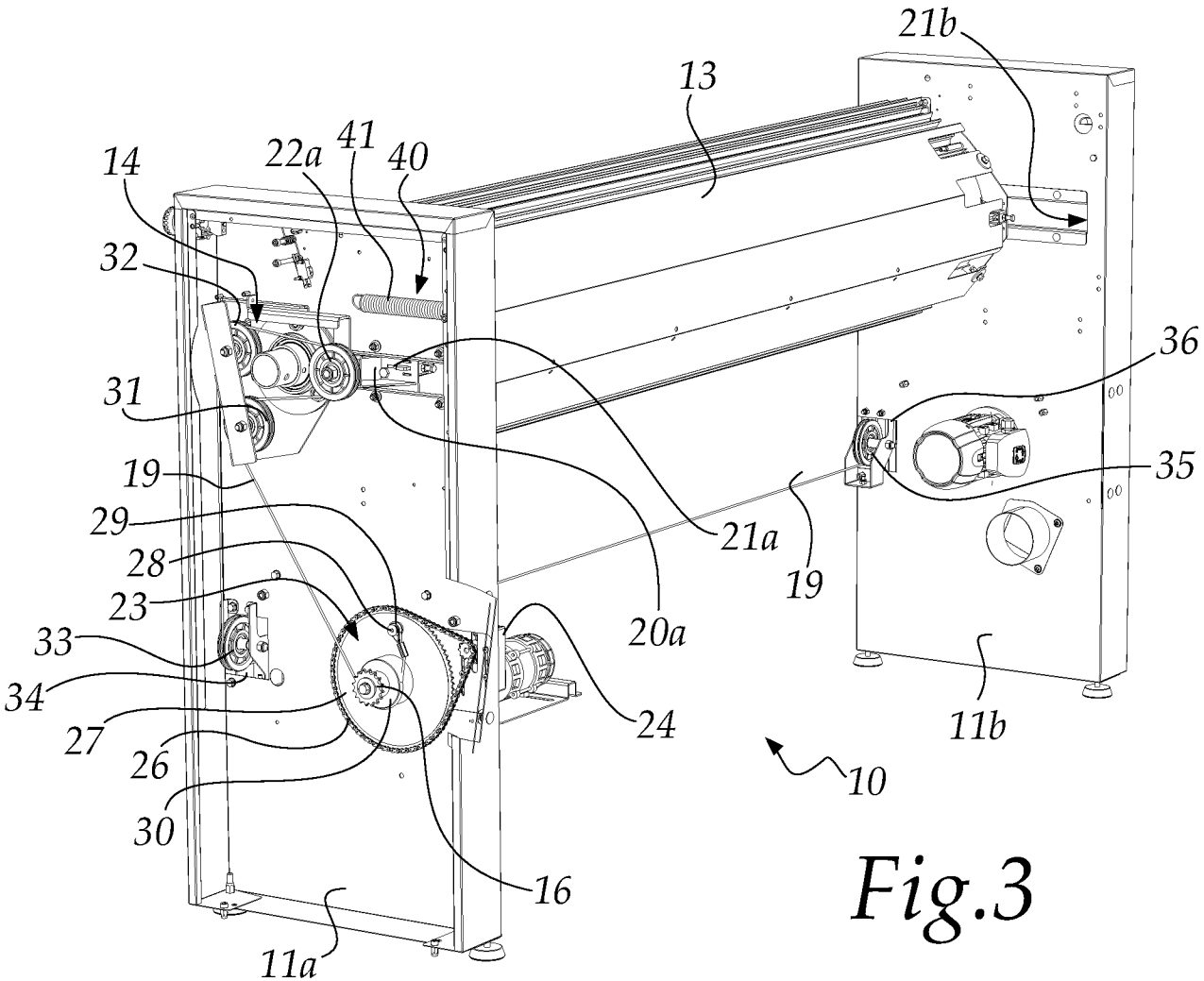
FIG. 3 is the same partial perspective view of FIG. 2 in which some details have been omitted.
Figure 4:
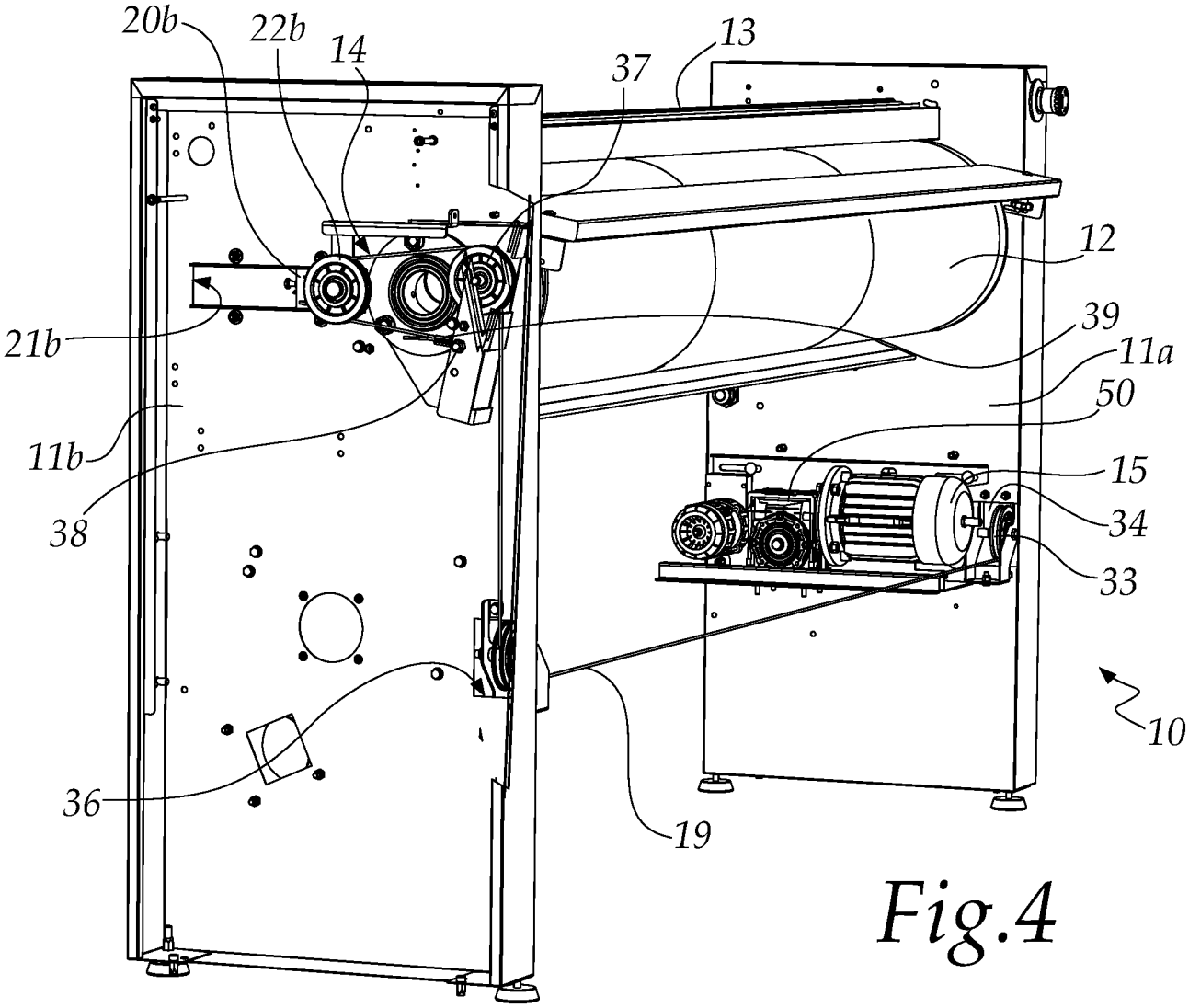
FIG. 4 is a second partial perspective view of the ironing press of FIG. 1.
Figure 5:
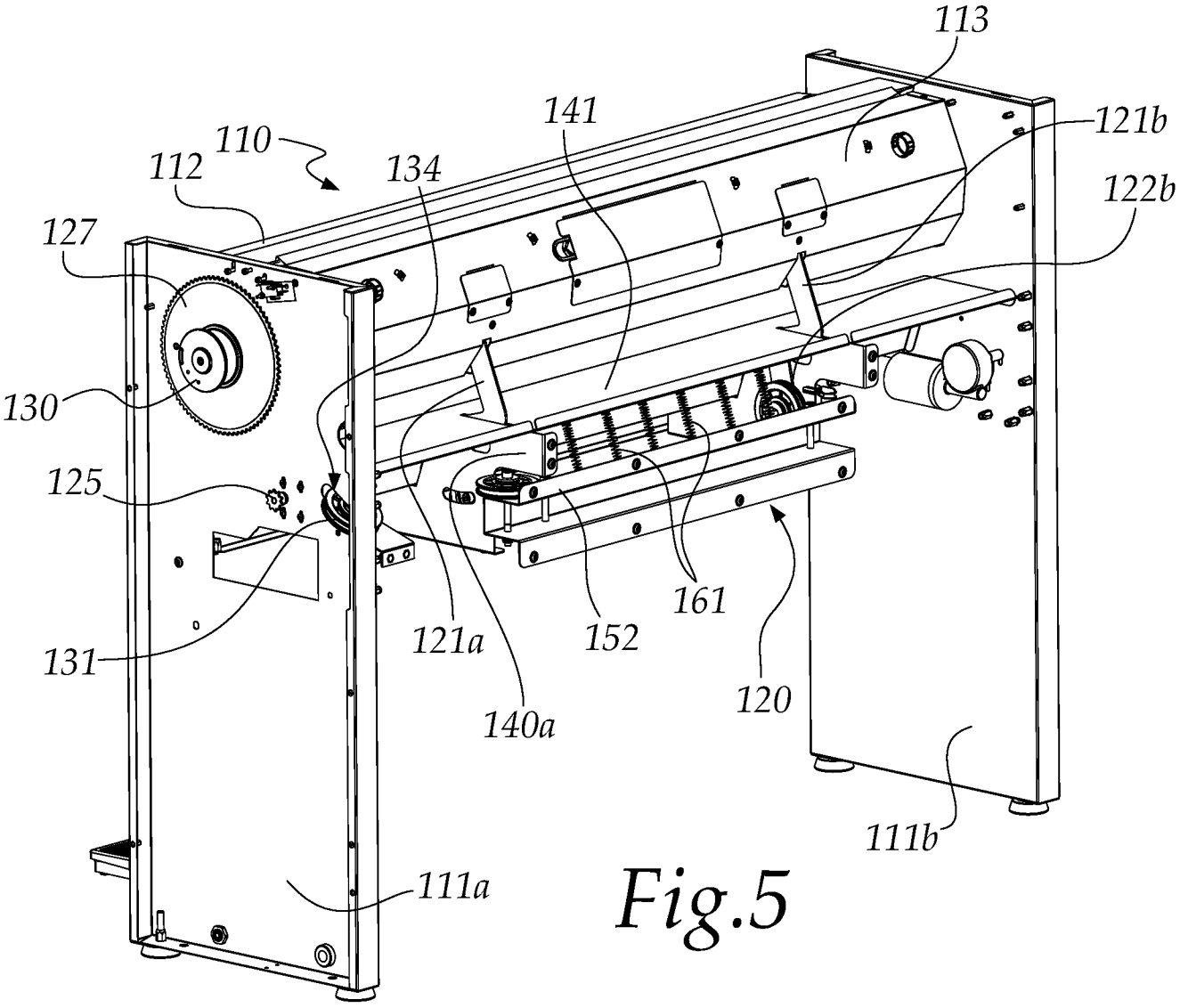
FIGS. 5 and 6 each show a different detail perspective view of a roller ironing press, according to the disclosure, in a second embodiment.
Figure 6:
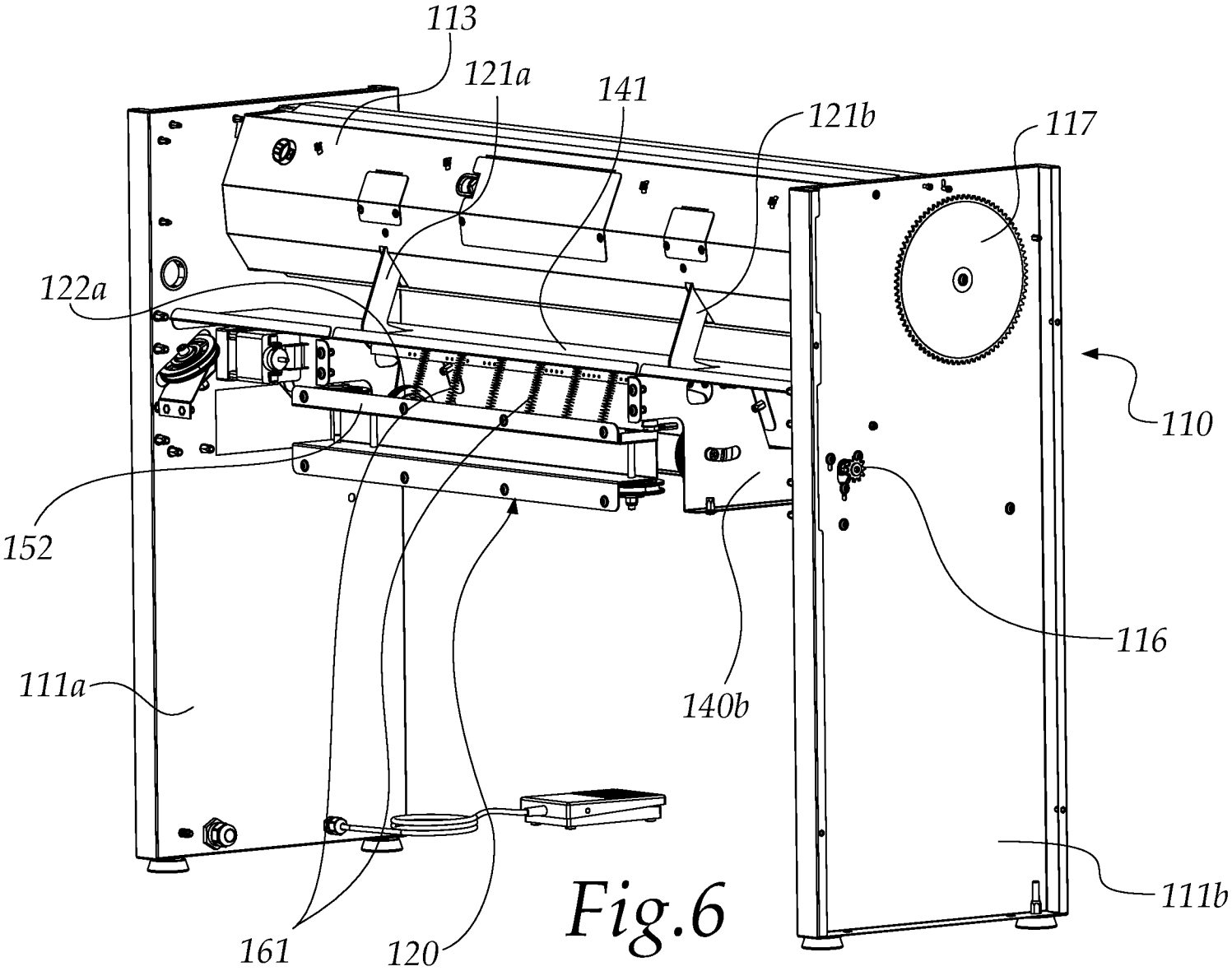
Figure 7:
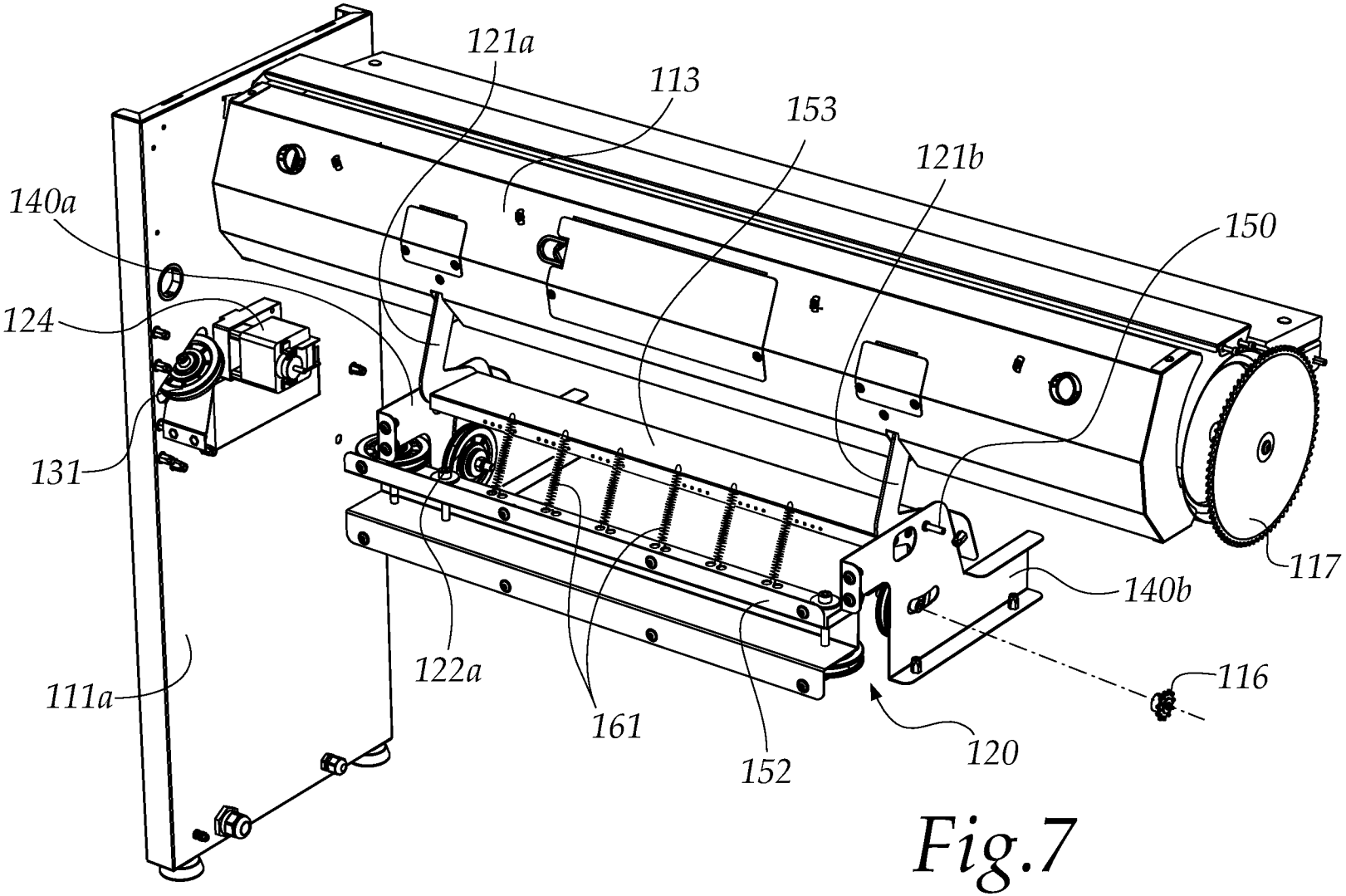
FIG. 7 is a first detail interior view of the ironing press of FIGS. 5 and 6.
Figure 8:
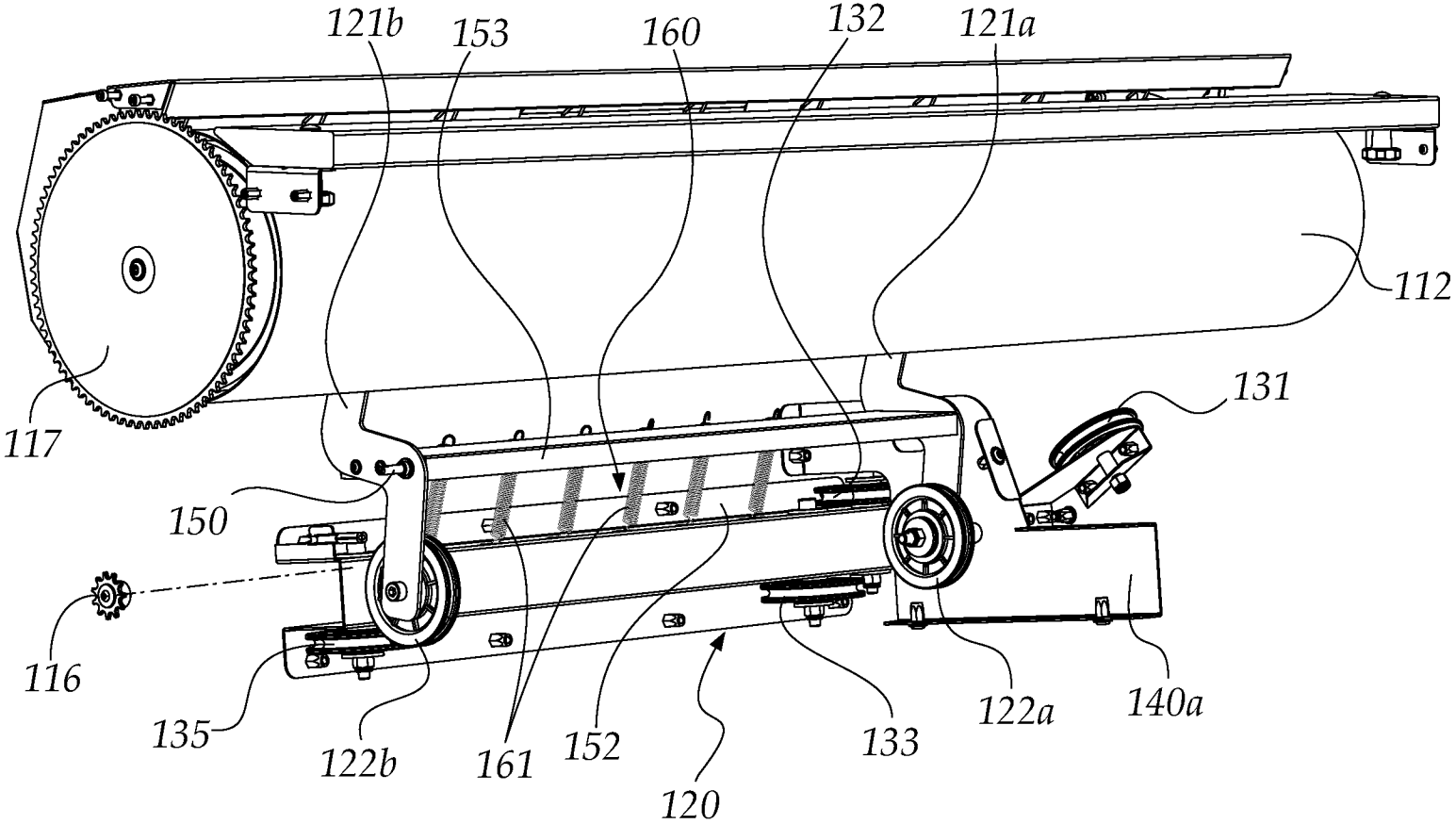
FIG. 8 is a second detail interior view of the ironing press of FIGS. 5 and 6.

In FIGS. 2, 3 and 4, the panel housing of the box-like body of the shoulders 11*a*, 11*b* has been removed (it can be seen in FIG. 1), to aid comprehension of the elements contained inside it.

In particular, the roller 12 is moved by way of a transmission unit actuated by an electric motor 15, which is arranged adjacent to the first shoulder 11*a* and is fixed to a crossmember (not shown in the figures).

The electric motor 15 is kinematically connected to a gear reduction unit 50, on the output shaft of which a first pinion 16 is keyed, which in turn is kinematically connected, by way of a first chain 18, to a second pinion 17, coaxial to the roller 12 and fixed to one end thereof.

One of the peculiarities of the ironing press 10 consists in that the means 14 for moving the presser means 13 toward the roller 12 comprise a cable 19 which extends between a plurality of pulleys.

In another embodiment, not shown in the figures, the means 14 for moving the presser means toward the roller comprise a plurality of cables which extend between a plurality of pulleys.

In particular, the presser means 13 can translate along a radial direction with respect to the roller 12, insofar as it has, at its longitudinal ends, prism-like tabs 20*a*, 20*b*, which can slide in guides 21*a*, 21*b*, defined by slotted holes which are present inside a respective support shoulder 11*a*, 11*b*.

A first pulley 22*a*, 22*b* is keyed on the prism-like tabs 20*a*, 20*b* and the cable 19 is able to slide around it, respectively a first first pulley 22*a* and a second first pulley 22*b*.

Such first pulley 22*a*, 22*b* has a rotation axis parallel to and/or coincident with the axis of longitudinal extension of the presser means 13 and is arranged at the end of the corresponding prism-like tab 20*a*, 20*b* that is opposite with respect to the presser means 13, and is directed toward the outside of the ironing press 10.

The cable 19 is moved by drive means 23 which are kinematically connected to one of its ends.

In another embodiment, not shown in the figures, the drive means are connected to both ends of the cable.

Such drive means 23 comprise, for example, a gear motor 24, which is fixed to the first shoulder 11*a*, on the output shaft of which a third pinion 25 is keyed, the latter being kinematically connected by way of a second chain 26 to a fourth pinion 27, which is coaxial to the first pinion 16 and keyed on the same shaft as the latter, but is idle with respect to it.

The fourth pinion 27 has a first pivot 28, with an axis of extension parallel to the rotation axis of the fourth pinion 27, to which the cable 19 is fixed by way of a first thimble 29, at a first end thereof, which stops the cable 19 from twisting during the steps of winding and unwinding thereof.

The first pivot 28 is, therefore, eccentric with respect to the center of rotation of the fourth pinion 27.

On the same side on which the first pivot 28 extends, the fourth pinion 27 has a second pulley 30 for winding the cable 29, coaxial thereto and integral therewith, being provided in a single piece thereon.

The second pulley 30 is, effectively, a cable-winding drum.

The fourth pinion 27 is arranged below the second pinion 17.

In the present description the terms "below", "above", "lower", "upper", "over", "under", etc. refer to the configuration for use of the ironing press.

The ironing press 10 comprises a plurality of guide pulleys of the cable 19.

In fact, starting from the second pulley 30, the cable 19 interacts along its path, in the following order, with:

- a third pulley 31, which is idle and is fixed to the first shoulder 11*a* and has a fixed rotation axis parallel to the rotation axis of the second pulley 30,
- the first first pulley 22*a*, which is idle and can slide on the first shoulder 11*a* and has a rotation axis parallel to the rotation axis of the second pulley 30, and which can translate along the respective guide 21*a*,
- a fourth pulley 32, which is idle and is fixed to the first shoulder 11*a* and has a fixed rotation axis parallel to the rotation axis of the second pulley 30, and which is arranged above the third pulley 31,
- a fifth pulley 33, which is idle and is arranged proximate to a through hole 34 of the first shoulder 11*a* and is fixed to the latter, with a fixed rotation axis parallel to the plane of arrangement of the second pulley 30, and is arranged below the third pulley 31,
- a sixth pulley 35, which is idle and is arranged proximate to a through hole 36 of the second shoulder 11*b* and is fixed to the latter, with a fixed rotation axis parallel to the plane of arrangement of the second pulley 30, and is arranged substantially at the fifth pulley 33,
- a seventh pulley 37, which is idle and is fixed to the second shoulder 11*b* and has a fixed rotation axis parallel to the rotation axis of the second pulley 30, and which is arranged above the sixth pulley 35,
- the second first pulley 22*b*, which is idle and can slide on the second shoulder 11*b* and has a rotation axis parallel to the rotation axis of the second pulley 30, and which can translate along the respective guide 21*b*, the rotation axis of the second first pulley 22*b* lying on a plane which is lower than or substantially coincident with the plane of arrangement of the rotation axis of the seventh pulley 37.

The cable 19 is, therefore, fixed at a second end thereof to the second shoulder 11*b*, to a second pivot 38 fixed to the second shoulder 11*b* by way of a second thimble 39.

Alternatively, the cable is fixed at a second end thereof to the second shoulder 11*b* by way of a different fixing element such as, for example, a clamp or a cast head, or the like.

It should be noted that the cable 19, in another embodiment not shown in the figures, is moved by the same electric motor that moves the roller, by way of an adapted coupling.

It should also be noted that such a configuration of pulleys and the use of the cable 19 makes it possible to provide a considerably compact apparatus.

The ironing press 10 comprises return means 40 affecting the presser means 13, for example elastic return means, constituted by a helical spring 41, with an axis of extension parallel to the axis of extension of the guide 21*a*, 21*b*, and fixed:

- at a first, fixed end, inside the box-like body of a respective shoulder 11*a*, 11*b*,
- at a second, moveable end, to a respective tab 20*a*, 20*b* of the presser means 13.

In other variations of embodiment, not shown in the figures, the return means comprise, for example, gas cylinder actuators, or weights, or the like.

The figures show, for the sake of simplicity, only the spring 41 applied to the first shoulder 11*a*.

In particular, the springs 41 have:

- an inactive configuration, with the presser means 13 at the maximum distance from the roller 12,
- an elongated configuration, with the presser means 13 substantially in contact with the roller 12.

Such spring 41 is adapted to return the presser means 13 to the initial position once the tension on the cable 19 is removed, so moving the presser means 13 away from the roller 12, and returning to its inactive configuration.

Movement of the presser element 13 of the ironing press 10 occurs in the following manner.

When it is necessary to move the presser means 13 toward the roller 12 the gear motor 24 rotates the third pinion 25, which entrains the second chain 26, in turn rotating the fourth pinion 27.

By virtue of the rotation of the fourth pinion 27, the cable 19 fixed thereto, through the first pivot 28, is wound around the second pulley 30, thus placing a tension on the cable 19 itself.

Simultaneously, by virtue of the configuration of the other pulleys, as the cable 19 is wound on the second pulley 30, the presser means 13 moves toward the roller 12, performing a translational motion with its tabs 20*a*, 20*b*, along the guides 21*a*, 21*b*, substantially until it comes into contact with the roller 12 along its entire longitudinal direction.

Upon reaching the working position, the presser means 13 presses against the roller 12, but because it cannot go further, the tension on the cable 19 increases until it exceeds the twisting moment imposed by the gear motor 24 and the latter stops, while maintaining the tension on the cable 19.

The tension on the cable 19 can be adjusted by conveniently varying the operating parameters of the gear motor 24, according to the requirements/types of fabrics to be ironed.

If the mains power supply cuts out, by virtue of the elastic return of the return means 40 and of the reversibility of the gear motor 24, the presser means 13 returns to the initial position, moving away from the roller 12.

To move the presser means 13 away from the roller 12, it is sufficient to remove the tension on the cable 19, by interrupting the action of the gear motor 24.

By virtue of the elastic return action of the springs 41, the presser means 13 is returned to the initial, inactive position. The losses owing to inherent friction of the gear motor 24 enable a gradual return of the presser means 13, thus preventing sudden movements and the derailment of the cable 19.

In particular, the springs 41, when they are in the inactive position, still conserve a residual tension, which is capable of maintaining a minimal tension in the cable 19 which is adapted to make it stay in the configuration along its entire path.

This prevents derailments or movements when inactive and during transport of the apparatus.

It should be noted that the first pivot 28, which is eccentric with respect to the center of rotation of the fourth pinion 27 and of the second pulley 30 (cable-winding drum), makes it possible to obtain the following advantages, in addition to maintaining the direction of pull of the cable 19:

- a more stable position of equilibrium with respect to the second pulley 30,
- a more rapid initial movement of the presser means 13,
- canceling out any additional strokes of the cable 19 during the return phase,
- maintaining the pull of the cable 19 with the apparatus 10 when inactive.

FIGS. 5 to 8 show an ironing press according to the disclosure in a second embodiment, generally designated by the reference numeral 110, and shown only partially in order to facilitate comprehension of its operation.

The ironing press 110 comprises, between two supporting shoulders 111*a*, 111*b*, respectively a first shoulder 111*a* and a second shoulder 111*b*:

- a motorized roller 112, which cooperates with a presser means 113,
- such presser means 113, heated, and shaped complementarily to the roller 112,
- means for moving the presser means 113 toward the roller 112.

In a further embodiment, not shown in the figures, there are more than one presser means.

The ironing press 110 is similar to the ironing press illustrated above, and also in such embodiment the means for moving the presser means 113 toward the roller 112 comprise at least one cable, not shown in the figures, which extends between a plurality of pulleys.

In particular, the roller 112 is moved by way of an electric motor, not shown in the figures, which is arranged adjacent to the second shoulder 111*b*, on the output shaft of which a first pinion 116 is keyed, which is kinematically connected, by way of a first chain, not shown in the figures, to a second pinion 117, coaxial to the roller 112 and fixed at one end of the latter.

The presser means 113 can translate along a radial direction with respect to the roller 112, by virtue of the action of a group of lever systems 120, described below, which has at its ends, two opposite and parallel first pulleys 122*a*, 122*b*, respectively a first first pulley 122*a* and a second first pulley 122*b*.

Such first pulley 122*a*, 122*b* has a rotation axis parallel to and/or coincident with the axis of longitudinal extension of the presser means 113.

The group of lever systems has two or more arms 121*a*, 121*b*, which are substantially S-shaped, each one of which is fixed:

- at a first end, to a respective first pulley 122*a*, 122*b*,
- at a second end, opposite to the first end, to the presser means 113.

In a further embodiment, not shown in the figures, the group of lever systems has a single aim.

The first pulleys 122*a*, 122*b* are arranged below the presser means 113 and each one of the arms 121*a*, 121*b*, is pivoted by way of a hinge 150, in a substantially central position, to a corresponding bracket, respectively a first bracket 140*a* and a second bracket 140*b*, which extends below a beam 141 between the shoulders 111*a*, 111*b* of the ironing press 110.

The beam 141 is also arranged below the presser means 113.

A first crossmember 152 extends between the first bracket 140*a* and the second bracket 140*b* and is perpendicular to both.

The cable is moved by drive means, not shown in the figures, which are kinematically connected to one of its ends.

Such drive means are fixed to the first shoulder 111*a* and comprise, for example, a gear motor 124, which is fixed to the first shoulder 111*a*, on the output shaft of which a third pinion 125 is keyed, the latter being kinematically connected, by way of a second chain, not shown in the figures, to a fourth pinion 127.

Such fourth pinion 127 can be coaxial to the axis of the roller 112 and keyed on the same shaft as the latter, but idle with respect to it.

The fourth pinion 127 has a first pivot, not shown in the figures, with an axis of extension parallel to the rotation axis of the fourth pinion 127, to which the cable is fixed by way of a first thimble, not shown in the figures, at a first end thereof, which stops that cable from twisting during the steps of winding and unwinding thereof.

Such first pivot is eccentric with respect to the center of rotation of the fourth pinion 127.

On the same side on which the first pivot extends, the fourth pinion 127 has a second pulley 130 for winding the cable, coaxial thereto and integral therewith, being provided in a single piece thereon.

Such second pulley 130 is, effectively, a cable-winding drum.

The ironing press 110 comprises a plurality of guide pulleys of the cable.

In fact, starting from the second pulley 130, the cable interacts along its path, in the following order, with:

- a third pulley 131, which is idle and is fixed to the first shoulder 111*a*, at a through hole 134 thereof, with a fixed rotation axis lying on a plane that is parallel to the plane of arrangement of the second pulley 130,
- a fourth pulley 132, which is idle and is fixed to the first crossmember 152, with a fixed rotation axis lying on a plane that is perpendicular to the plane of arrangement of the second pulley 130,
- the first first pulley 122*a*, which is idle, moveable with respect to the first shoulder 111*a*, with a rotation axis parallel to the rotation axis of the second pulley 130, and which can translate along a trajectory represented by a circular arc with the respective hinge 150 as its center,
- a fifth pulley 133, which is idle and is fixed to the first crossmember 152, with a fixed rotation axis lying on a plane parallel to the plane of arrangement of the second pulley 130, and is arranged below the fourth pulley 132 and substantially parallel thereto,
- a sixth pulley 135, which is idle and is fixed to the first crossmember 152 and lying on the same plane of arrangement as the fifth pulley 133,
- the second first pulley 122*b*, which is idle, coaxial to the first first pulley 122*a* and moveable with respect to the second shoulder 111*b*, with a rotation axis parallel to the rotation axis of the second pulley 130, and which can translate along a trajectory represented by a circular arc with the respective hinge 150 as its center.

The cable is, therefore, fixed at a second end thereof to the first crossmember 152, exiting from the second first pulley 122*b*.

The ironing press 110 comprises return means 160 affecting the presser means 113, which are constituted by a plurality of helical springs 161, each one with an axis of extension lying on a plane parallel to the plane of arrangement of the first pulley 122*a*, 122*b*.

In particular, the springs 161, when they are in the inactive position, still conserve a residual tension, which is capable of maintaining a minimal tension in the cable which is adapted to make it stay in the configuration along its entire path.

This prevents derailments or movements when inactive and during transport of the apparatus 110.

It should be noted that the first pivot, which is eccentric with respect to the center of rotation of the fourth pinion 127 and of the second pulley 130 (cable-winding drum), makes it possible to obtain the following advantages, in addition to maintaining the direction of pull of the cable:

- a more stable position of equilibrium with respect to the second pulley 130,
- a more rapid initial movement of the presser means 113,
- canceling out any additional strokes of the cable during the return phase,
- maintaining the pull of the cable with the apparatus 110 when inactive.

Each one of the springs 161 is fixed:

- at a first, fixed end, to a first crossmember 152 which extends between the first bracket 140*a* and the second bracket 140*b*, perpendicular to both,
- at a second, moveable end, to a second crossmember 153 which extends between the arms 121*a*, 121*b*, perpendicular to both, with an axis of extension coincident with the axis of extension of the hinges 150.

In particular the second crossmember 153:

- is parallel to the beam 141 and is arranged below it,
- is parallel to the first crossmember 152 and is arranged above it.

The springs 161 have:

- an inactive configuration, with the presser means 113 at the maximum distance from the roller 112,
- an elongated configuration, with the presser means 113 substantially in contact with the roller 112.

Such springs 161 are adapted to return the presser means 113 to the initial position once the tension on the cable is removed, so moving the presser means 113 away from the roller 112, and returning to its inactive configuration.

Movement of the presser means 113 of the ironing press 110 occurs in the following manner.

When it is necessary to move the presser means 113 toward the roller 112 the gear motor 124 rotates the third pinion 125, which entrains the second chain, in turn rotating the fourth pinion 127.

By virtue of the rotation of the fourth pinion 127, the cable fixed thereto, through the first pivot, is wound around the second pulley 130, thus placing a tension on the cable itself.

Simultaneously, by virtue of the configuration of the other pulleys, as the cable is wound on the second pulley 130, the first pulleys 122*a*, 122*b* perform a translational motion along a circular arc with its center corresponding to the hinge 150 and, simultaneously, the arms 121*a*, 121*b* rotate about the hinge 150, moving the presser means 113 toward the roller 112.

To move the presser means 113 away from the roller 112, it is sufficient to remove the tension on the cable, by interrupting the action of the gear motor 124.

By virtue of the elastic return action of the springs 161, the presser means 113 is returned to the initial, inactive position.

In an additional embodiment, not shown in the figures, the ironing press has a system of moving the presser means that is effectively a combination of the two systems described above, in which the cable, during winding, moves:

lateral supports of the presser means which can slide in guides, as in the first embodiment described, a group of lever systems with one or more arms in a central region of the presser means, as in the second embodiment described.

In all its embodiments, the ironing press according to the disclosure comprises a finger-guard rod, not shown in the figures, which is placed transversely between the presser means and the roller, the actuation of which, in the event of malfunction or problems, makes it possible to cut the power to the gear motor and therefore the tension on the cable, so moving the presser means away from the roller.

It should be noted that the use of a cable between a plurality of guide pulleys makes it possible to render the mechanism for moving the pressing element toward the roller independent of the length of the ironing press, in that it is sufficient to modify the length of the cable, according to the length of the latter.

It should also be noted that operation of the ironing press according to the disclosure is silent.

Also, for its operation the ironing press according to the disclosure uses standardized components, irrespective of the dimensions of the apparatus and this enables economical construction and maintenance.

Furthermore, it should be noted that the use of a thimble to fix the cable to the pivot, integral with the third pinion, makes it possible to precisely maintain the direction of the cable toward the second pulley, integral with the third pinion, independently of the angle/rotation of that pinion.

It should be noted that, depending on the dimensions of the second pulley and of the arrangement of its plane with respect to the anchoring plane of the cable to the third pinion, it is possible to provide winding elements for cables of considerable length.

It should be noted that with an apparatus according to the disclosure in the second embodiment thereof, it is possible to increase the thrust of the presser means on the roller, simply by increasing the number of the arms in the group of lever systems and consequent/corresponding passages of the cable, while at the same time maintaining a restrained tension on the cable with the apparatus in operation.

In practice it has been found that the disclosure fully achieves the intended aim and objects by providing a roller ironing press that has fewer components with respect to similar conventional apparatuses and/or the components of which are less prone to wear with respect to similar conventional apparatuses.

With the disclosure a roller ironing press has been devised that is simpler in construction and more straightforward to manufacture with respect to similar conventional apparatuses.

The disclosure thus conceived is susceptible of numerous modifications and variations, all of which are within the scope of the appended claims. Moreover, all the details may be substituted by other, technically equivalent elements.

In practice the materials employed, provided they are compatible with the specific use, and the contingent dimensions and shapes, may be any according to requirements and to the state of the art.

What is claimed is:

1. A roller ironing press comprising, between two supporting shoulders, respectively a first shoulder and a second shoulder:

a motorized roller, which cooperates with one or more presser means, said one or more presser means being heated and shaped complementarily to said motorized roller, and means for moving said one or more presser means toward said motorized roller, wherein said means for moving said one or more presser means toward said motorized roller comprise at least one cable which extends between a plurality of pulleys, said cable being moved by drive means which are kinematically connected to at least one end of said cable, wherein said motorized roller is moved by a transmission unit actuated by an electric motor arranged adjacent to one of said shoulders, said electric motor being kinematically connected to a gear reduction unit on an output shaft of the electric motor of which a first pinion is keyed, said first pinion being kinematically connected, by way of a first chain, to a second pinion, said second pinion being coaxial to said motorized roller and being fixed to one end thereof.

2. The ironing press according to claim 1, further comprising return means affecting said one or more presser means.

3. The ironing press according to claim 2, wherein said return means affecting said one or more presser means are constituted by helical springs, each one with an axis of extension parallel to an axis of extension of guides defined by slotted holes which are present inside a respective one of said shoulders, and each one being fixed:

at a first, fixed end, inside a respective one of said shoulders, and at a second, moveable end, to a respective one of said prism-like tabs of said one or more presser means, said prism-like tabs disposed at longitudinal ends of said one or more presser means and configured to slide in said guides, said springs having:

an inactive configuration, with said one or more presser means at a maximum distance from said motorized roller, and an elongated configuration, with said one or more presser means substantially in contact with said motorized roller.

4. The ironing press according to claim 3, wherein said return means affecting said one or more presser means are constituted by a plurality of helical springs, with an axis of extension lying on a plane parallel to a plane of arrangement of two opposite and parallel first pulleys, each one of said springs being fixed:

at a first, fixed end, to a first crossmember which extends between a first bracket and a second bracket, perpendicular to both said first and second brackets, at a second, moveable end, to a second crossmember which extends between arms of a group of lever systems, perpendicular to said arms, with an axis of extension coincident with an axis of extension of said hinge, said second crossmember being:

parallel to a beam and arranged below said beam, said beam being arranged between said shoulders below said one or more presser means, and parallel to said first crossmember and arranged above said first crossmember, said springs having:

an inactive configuration, with said one or more presser means at the maximum distance from said motorized roller, and an elongated configuration, with said one or more presser means substantially in contact with said motorized roller.

5. The ironing press according to claim 1, wherein said one or more presser means being configured to translate along a radial direction with respect to said roller as a result of an action of a group of lever systems, said group of lever systems having, at ends thereof, two opposite and parallel first pulleys, respectively a first first pulley and a second first pulley, said first pulleys having a rotation axis parallel to or coincident with a longitudinal axis of extension of said one or more presser means.

6. The ironing press according to claim 5, wherein said group of lever systems has two or more arms, each one of said arms being fixed:

at a first end, to a respective one of said first pulleys, and at a second end, which is opposite from the first, to said one or more presser means, said first pulleys being arranged below said one or more presser means, each one of said arms being pivoted by way of a hinge, in a substantially central position, to a corresponding bracket, respectively a first bracket and a second bracket, said bracket extending below a beam, said beam being arranged between said shoulders below said one or more presser means, a first cross-member extending between said first bracket and said second bracket and being perpendicular to both said first and second brackets.

7. A roller ironing press comprising, between two supporting shoulders, respectively a first shoulder and a second shoulder:

a motorized roller, which cooperates with one or more presser means, said one or more presser means being heated and shaped complementarily to said motorized roller, and means for moving said one or more presser means toward said motorized roller, wherein said means for moving said one or more presser means toward said motorized roller comprise at least one cable which extends between a plurality of pulleys, said cable being moved by drive means which are kinematically connected to at least one end of said cable, wherein said one or more presser means are configured to translate along a radial direction with respect to said motorized roller, said one or more presser means having, at longitudinal ends thereof, prism-like tabs configured to slide in guides defined by slotted holes which are present inside a respective one of said shoulders, a first pulley being keyed on said prism-like tabs and said cable being able to slide around it, said first pulley comprising a first first pulley and a second first pulley.

8. The ironing press according to claim 7, wherein said first pulley has a rotation axis which is parallel to or coincident with an axis of longitudinal extension of said one or more presser means and is arranged at an end of a corresponding one of said prism-like tabs that is opposite with respect to said one or more presser means and is directed toward an outside of said ironing press.

9. A roller ironing press comprising, between two supporting shoulders, respectively a first shoulder and a second shoulder:

a motorized roller, which cooperates with one or more presser means, said one or more presser means being heated and shaped complementarily to said motorized roller, and means for moving said one or more presser means toward said motorized roller, wherein said means for moving said one or more presser means toward said motorized roller comprise at least one cable which extends between a plurality of pulleys, said cable being moved by drive means which are kinematically connected to at least one end of said cable, wherein said drive means comprise a gear motor which is fixed to said first shoulder on an output shaft of which a third pinion is keyed, said third pinion being kinematically connected by way of a second chain to a fourth pinion, said fourth pinion having a first pivot with an axis of extension that is parallel to a rotation axis of said fourth pinion, said cable being fixed to said first pivot by way of a first thimble at a first end of the cable.

10. The ironing press according to claim 9, wherein said fourth pinion is coaxial to said first pinion and is keyed on a same shaft as the first pinion, said fourth pinion being idle with respect to said first pinion.

11. The ironing press according to claim 9, wherein said fourth pinion has a second pulley which is coaxial thereto and integral therewith.

12. The ironing press according to claim 11, further comprising in the plurality of pulleys for guiding said cable; starting from said second pulley said cable interacting along a path thereof, in the following order, with:

a third pulley, which is idle and is fixed to said first shoulder and has a fixed rotation axis parallel to a rotation axis of said second pulley, said first first pulley, which is idle and is configured to slide on said first shoulder and has a rotation axis parallel to the rotation axis of said second pulley, and configured to translate along the respective guide, a fourth pulley, which is idle and is fixed to said first shoulder and has a fixed rotation axis parallel to the rotation axis of said second pulley, and which is arranged above said third pulley, a fifth pulley, which is idle and is arranged proximate to a through hole of said first shoulder and is fixed to the latter, said fifth pulley having a fixed rotation axis parallel to the plane of arrangement of said second pulley, said fifth pulley being arranged below said third pulley, a sixth pulley, which is idle and is arranged proximate to a through hole of said second shoulder and is fixed to the latter, said sixth pulley having a fixed rotation axis parallel to the plane of arrangement of said second pulley, said sixth pulley being arranged substantially at said fifth pulley, and a seventh pulley, which is idle and is fixed to said second shoulder, with a fixed rotation axis parallel to the rotation axis of said second pulley, said seventh pulley being arranged above said sixth pulley, said second first pulley, which is idle and is configured to slide on said second shoulder and has a rotation axis parallel to the rotation axis of said second pulley, and configured to translate along the respective guide, said rotation axis of said second first pulley being arranged on a plane which is lower than or substantially coincident with the plane of arrangement of the rotation axis of said seventh pulley, said cable being fixed by way of a second thimble at a second end thereof to said second shoulder.

13. The ironing press according to claim 11, further comprising in the plurality of pulleys for guiding said cable; starting from said second pulley said cable interacting along its path, in the following order, with:

a third pulley, which is idle and is fixed to said first shoulder at a through hole thereof with a fixed rotation axis lying on a plane that is parallel to a plane of arrangement of said second pulley, a fourth pulley, which is idle and is fixed to said first crossmember, with a fixed rotation axis lying on a plane that is perpendicular to the plane of arrangement of said second pulley, said first first pulley, which is idle, moveable with respect to said first shoulder, with a rotation axis parallel to the rotation axis of said second pulley, and configured to translate along a trajectory represented by a circular arc with the respective hinge as its center, a fifth pulley, which is idle and is fixed to said first crossmember, with a fixed rotation axis lying on a plane that is parallel to the plane of arrangement of said second pulley, said fifth pulley being arranged below said fourth pulley and substantially parallel thereto, and a sixth pulley, which is idle and is fixed to said first crossmember and lying on the same plane of arrangement as said fifth pulley, said second first pulley, which is idle, coaxial to said first first pulley and moveable with respect to said second shoulder with a rotation axis parallel to the rotation axis of said second pulley, and configured to translate along a trajectory represented by a circular arc with the respective hinge as its center, said cable being fixed at a second end thereof to said first crossmember exiting from said second first pulley.

* * * * *